US011526092B2

(12) United States Patent
Iwasaki et al.

(10) Patent No.: US 11,526,092 B2
(45) **Date of Patent: *Dec. 13, 2022**

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventors: Masahiro Iwasaki, Kanagawa (JP); Wataru Yamada, Kanagawa (JP); Keisuke Kusano, Kanagawa (JP); Yuto Okazaki, Kanagawa (JP); Taisuke Fukui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 21 days.

This patent is subject to a terminal disclaimer.

(21) Appl. No.: 15/931,691

(22) Filed: May 14, 2020

(65) Prior Publication Data

US 2021/0181645 A1 Jun. 17, 2021

(30) Foreign Application Priority Data

Dec. 17, 2019 (JP) ..... JP2019-227003

(51) Int. Cl.
*G03G 5/147* (2006.01)
*G03G 15/00* (2006.01)
*G03G 21/18* (2006.01)

(52) U.S. Cl.
CPC ..... *G03G 5/14726* (2013.01); *G03G 15/75* (2013.01); *G03G 21/1803* (2013.01)

(58) Field of Classification Search
CPC ..... G03G 5/14726
USPC ..... 430/66
See application file for complete search history.

(56) References Cited

U.S. PATENT DOCUMENTS

| | | | | |
|---|---|---|---|---|
| 4,742,122 | A * | 5/1988 | Buckmaster | C08J 3/124 525/326.4 |
| 5,115,038 | A | 5/1992 | Ihara et al. | |
| 10,538,605 | B2 | 1/2020 | Yoshida et al. | |
| 11,016,404 | B2 * | 5/2021 | Sasaki | G03G 5/0592 |
| 2010/0168301 | A1 * | 7/2010 | Sawauchi | C08J 3/05 524/80 |

(Continued)

FOREIGN PATENT DOCUMENTS

| | | |
|---|---|---|
| JP | 4-020507 A | 1/1992 |
| JP | 2018-024868 A | 2/2018 |
| JP | 2018-024869 A | 2/2018 |

OTHER PUBLICATIONS

SIDS initial Assessment Profile of dodecylbenzenesulfonic acid; SIAM 28, Apr. 15-17, 2009; https://hpvchemicals.oecd.org/ui/handler.axd?id=42291500-a126-4081-b2eb-fa354064d604#:~:text=Dodecylbenzenesulfonic%20acid%20(DBS)%20is%20a,pH%20range%204%20to%209.*

*Primary Examiner* — Peter L Vajda
(74) *Attorney, Agent, or Firm* — Sughrue Mion, PLLC

(57) ABSTRACT

An electrophotographic photoreceptor includes a conductive substrate and a photosensitive layer on the conductive substrate. The outermost surface layer of the electrophotographic photoreceptor contains fluorine-containing resin particles, a fluorine graft polymer, and an acidic compound having an acid dissociation constant (pKa) of 3 or less in water at 25° C. The amount of the acidic compound relative to the outermost surface layer is 100 ppm or more and 10000 ppm or less.

11 Claims, 3 Drawing Sheets

(56) References Cited

U.S. PATENT DOCUMENTS

| | | | | |
|---|---|---|---|---|
| 2013/0252152 | A1* | 9/2013 | Kawabata ..... | G03G 5/14713<br>430/66 |
| 2019/0023856 | A1 | 1/2019 | Yoshida et al. | |
| 2020/0123283 | A1 | 4/2020 | Yoshida et al. | |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-227003 filed Dec. 17, 2019.

BACKGROUND

(i) Technical Field

The present disclosure relates to an electrophotographic photoreceptor, a process cartridge, and an image forming apparatus.

(ii) Related Art

An electrophotographic image forming apparatus known heretofore is equipped with an electrophotographic photoreceptor, and sequentially performs such steps as charging, electrostatic latent image forming, developing, transfer, and cleaning.

As the electrophotographic photoreceptor, a photoreceptor having an outermost surface layer containing fluorine-containing resin particles is known.

Examples of the fluorine-containing resin particles include particles obtained by radiation irradiation and particles obtained by polymerization.

For example, Japanese Unexamined Patent Application Publication No. 2018-24869 discloses a "method for producing a low-molecular-weight polytetrafluoroethylene, the method including (1) a step of placing, into a closed vessel, polytetrafluoroethylene, at least one additive selected from the group consisting of a hydrocarbon, a chlorinated hydrocarbon, an alcohol, and a carboxylic acid (however, perfluorocarboxylic acids having 8 or more and 14 or less carbon atoms are excluded), and at least one selected from the group consisting of an inert gas (however, the aforementioned additives are excluded) and an oxygen absorber; and (2) a step of irradiating the polytetrafluoroethylene with radiation so as to obtain a low-molecular-weight polytetrafluoroethylene having a complex viscosity at 380° C. of $1\times10^2$ to $7\times10^5$ Pa·s".

Japanese Unexamined Patent Application Publication No. 2018-24868 discloses a "method for producing a low-molecular-weight polytetrafluoroethylene, the method including (1) a step of irradiating polytetrafluoroethylene with radiation to obtain a low-molecular-weight polytetrafluoroethylene having a melt viscosity at 380° C. of $1\times10^2$ to $7\times10^5$ Pa·s, (2) a step of crushing the low-molecular-weight polytetrafluoroethylene, and (3) heat-treating the low-molecular-weight polytetrafluoroethylene crushed in the step (2)".

Japanese Unexamined Patent Application Publication No. 4-20507 discloses a "tetrafluoroethylene copolymer of tetrafluoroethylene and at least one perfluoro(alkyl vinyl ether), in which 1 to 10 wt % of the perfluoro(alkyl vinyl ether) unit is contained, the number of —$CONH_2$ terminal groups is 7 to 20 per $10^6$ carbon atoms, neither —$CH_2OH$ nor —COF is contained, and the melt viscosity at 380° C. is $0.1\times10^4$ to $100\times10^4$ poise".

SUMMARY

Aspects of non-limiting embodiments of the present disclosure relate to an electrophotographic photoreceptor that includes a conductive substrate and a photosensitive layer on the conductive substrate, and this electrophotographic photoreceptor suppresses the increase in residual potential compared to when an acidic compound having an acid dissociation constant (pKa) exceeding 3 in water at 25° C. is contained, compared to when the amount of the acidic compound having an acid dissociation constant (pKa) of 3 or less in water at 25° C. is less than 100 ppm relative to the outermost surface layer, and compared to when isophthalic acid having an acid dissociation constant (pKa) of 3.54 in water at 25° C. is contained.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor includes a conductive substrate and a photosensitive layer on the conductive substrate. The outermost surface layer of the electrophotographic photoreceptor contains fluorine-containing resin particles, a fluorine graft polymer, and an acidic compound having an acid dissociation constant (pKa) of 3 or less in water at 25° C. The amount of the acidic compound relative to the outermost surface layer is 100 ppm or more and 10000 ppm or less.

BRIEF DESCRIPTION OF THE DRAWINGS

Exemplary embodiments of the present disclosure will be described in detail based on the following figures, wherein.

DETAILED DESCRIPTION

Figure 1:
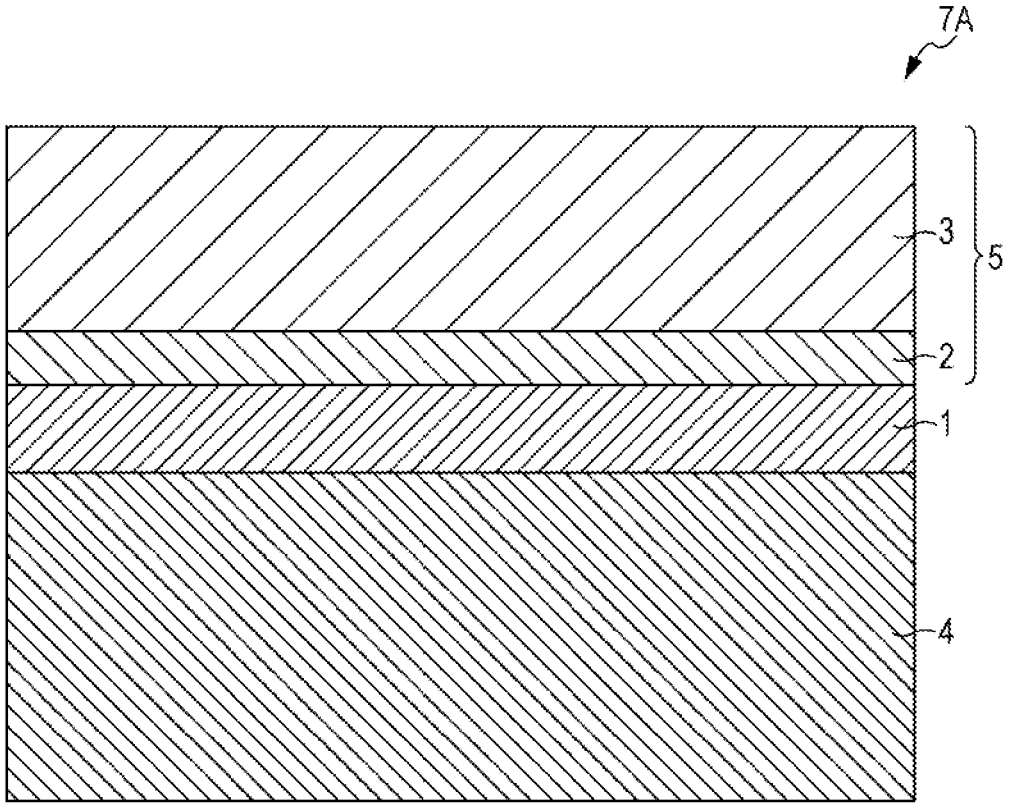
FIG. 1 is a schematic cross-sectional view of one example of a layer structure of an electrophotographic photoreceptor according to an exemplary embodiment.

In the description below, exemplary embodiments, which are some of aspects of the present disclosure, are described in detail.

In the present disclosure, the upper limit or the lower limit of one stepwise numerical range may be substituted with an upper limit or a lower limit of a different numerical range also described stepwise.

In any numerical range, the upper limit or the lower limit may be substituted with a value indicated in Examples.

When the amount of a component in a composition is referred and when there are two or more substances that correspond to that component in the composition, the amount is the total amount of the two or more substances in the composition unless otherwise noted.

The term "step" not only refers to an independent step but also to any instance that achieves the intended purpose of that step although such a step is not clearly distinguishable from other steps.

Electrophotographic Photoreceptor

An electrophotographic photoreceptor according to a first exemplary embodiment (hereinafter may be referred to as the "photoreceptor of the first exemplary embodiment")

includes a conductive substrate and a photosensitive layer on the conductive substrate, in which the outermost surface layer contains fluorine-containing resin particles, a fluorine graft polymer, and an acidic compound having an acid dissociation constant (pKa) of 3 or less in water at 25° C., and an amount of the acidic compound relative to the outermost surface layer is 100 ppm or more and 1.0% or less.

An electrophotographic photoreceptor according to a second exemplary embodiment (hereinafter may be referred to as the "photoreceptor of the second exemplary embodiment") includes a conductive substrate and a photosensitive layer on the conductive substrate, in which the outermost surface layer contains fluorine-containing resin particles, a fluorine graft polymer, and at least one acidic compound selected from the group consisting of a benzene ring-containing sulfonic acid compound, a carboxylic acid compound having 2 or more and 4 or less carboxyl groups, a phosphoric acid compound, and a nitric acid compound, and in which the amount of the acidic compound relative to the outermost surface layer is 100 ppm or more and 1.0% or less.

Examples of the outermost surface layer include a charge transporting layer of a multilayer photosensitive layer, a single-layer-type photosensitive layer, and a surface protection layer.

According to the photoreceptors of the first and second exemplary embodiments, the increase in residual potential is suppressed due to the aforementioned features. The reason behind this is presumably as follows.

When the "acidic compound having an acid dissociation constant (pKa) of 3 or less" or the "at least one acidic compound selected from the group consisting of a benzene ring-containing sulfonic acid compound, a carboxylic acid compound having 2 or more and 4 or less carboxyl groups, a phosphoric acid compound, and a nitric acid compound" is contained in the outermost surface layer, the resistance of the outermost surface layer is decreased.

Thus, when the amount of these acidic compounds contained is in the range of 100 ppm or more and 1.0% or less relative to the outermost surface layer, the resistance is appropriately decreased, and the increase in residual potential is suppressed.

Hereinafter, a photoreceptor that corresponds to both the first and second exemplary embodiments (this photoreceptor may also be referred to as a "photoreceptor of the present exemplary embodiment") is described in detail. However, one example of the photoreceptor of the present disclosure may be a photoreceptor that corresponds to one of the photoreceptors of the first and second exemplary embodiments.

The electrophotographic photoreceptor of the present exemplary embodiment will now be described in detail by referring to the drawings.

An electrophotographic photoreceptor 7 illustrated in FIG. 1 includes, for example, a conductive support 4, and an undercoat layer 1, a charge generating layer 2, and a charge transporting layer 3 that are stacked in this order on the conductive support 4. The charge generating layer 2 and the charge transporting layer 3 constitute a photosensitive layer 5.

The electrophotographic photoreceptor 7 may have a layer structure that does not include the undercoat layer 1.

The electrophotographic photoreceptor 7 may include a single-layer-type photosensitive layer in which the functions of the charge generating layer 2 and the charge transporting layer 3 are integrated. In the case of a photosensitive layer having a single-layer-type photosensitive layer, the single-layer-type photosensitive layer constitutes the outermost surface layer.

Alternatively, the electrophotographic photoreceptor 7 may include a surface protection layer on the charge transporting layer 3 or the single-layer-type photosensitive layer. In the case of a photoreceptor having a surface protection layer, the surface protection layer constitutes the outermost surface layer.

In the description below, the respective layers of the electrophotographic photoreceptor of the present exemplary embodiment are described in detail. In the description below, the reference signs are omitted.

Outermost Surface Layer

The outermost surface layer contains fluorine-containing resin particles, a fluorine graft polymer, and an acidic compound. The outermost surface layer contains additives depending on the type of layer it serves as (a charge transporting layer of a multilayer photosensitive layer, a single-layer-type photosensitive layer, or a surface protection layer). Details of the layer that the outermost surface layer serves as are described below.

Fluorine-Containing Resin Particles

Examples of the fluorine-containing resin particles include particles of a fluoroolefin homopolymer, and particles of a copolymer of two or more monomers which are at least one fluoroolefin monomer and a non-fluorine monomer (monomer free of fluorine atoms).

Examples of the fluoroolefin include perhaloolefins such as tetrafluoroethylene (TFE), perfluorovinylether, hexafluoropropylene (HFP), and chlorotrifluoroethylene (CTFE), and non-perfluoroolefins such as vinylidene fluoride (VdF), trifluoroethylene, and vinyl fluoride. Among these, VdF, TFE, CTFE, HFP, or the like may be used.

Examples of the non-fluorine monomers include hydrocarbon olefins such as ethylene, propylene and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having a reactive, α,β-unsaturated group such as vinyltrimethoxysilane (VSi), vinyltriethoxysilane, and vinyltris (methoxyethoxy)silane; acrylic esters such as methyl acrylate and ethyl acrylate; methacrylic esters such as methyl methacrylate and ethyl methacrylate; and vinyl esters such as vinyl acetate, vinyl benzoate, and "Beova" (trade name, vinyl ester manufactured by Shell). Among these, alkyl vinyl ether, allyl vinyl ether, vinyl ester, and an organosilicon compound having a reactive α,β-unsaturated group may be used.

Among these, particles having a high fluorination ratio may be used as the fluorine-containing resin particles. Particles of polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene, chlorotrifluoroethylene copolymer (ECTFE), and the like are more preferable, and particles of PTFE, FEP, and PFA are particularly preferable.

The fluorine-containing resin particles may have 0 or more and 30 or less carboxyl groups per $10^6$ carbon atoms, and may contain 0 ppm or more and 3 ppm or less of a basic compound.

When the number of carboxyl groups in the fluorine-containing resin particles and the amount of the basic compound are within the aforementioned ranges, the increase in residual potential is suppressed.

Examples of the fluorine-containing resin particles include particles obtained by radiation irradiation (in this description, also referred to as the "irradiated fluorine-containing resin particles") and particles obtained by polymerization (in this description, also referred to as the "polymerized fluorine-containing resin particles").

The irradiated fluorine-containing resin particles (the fluorine-containing resin particles obtained by irradiation with radiation) refer to fluorine-containing resin particles that have been given a particle form during radiation polymerization, and fluorine-containing resin particles obtained by irradiating a polymerized fluorine-containing resin with radiation so as to decompose the resin to reduce the molecular weight and to give a particle form.

The irradiated fluorine-containing resin particles contain many carboxyl groups since large quantities of carboxylic acids occur by irradiation in air.

Meanwhile, polymerized fluorine-containing resin particles (fluorine-containing resin particles obtained by polymerization) refer to fluorine-containing resin particles that have become particles during polymerization such as suspension polymerization or emulsion polymerization and that are not irradiated with radiation.

Since polymerized fluorine-containing resin particles are produced by polymerization in the presence of a basic compound, the basic compound is contained as a residue.

In other words, typical fluorine-containing resin particles contain large quantities of carboxyl groups or basic compounds.

When fluorine-containing resin particles contain many carboxyl groups, the particles exhibit ion conductivity and become difficult to charge.

When typical fluorine-containing resin particles containing many carboxyl groups are contained in the outermost surface layer of an electrophotographic photoreceptor, the chargeability of the photoreceptor in a high-temperature, high-humidity environment may become degraded.

Meanwhile, when the fluorine-containing resin particles contain a large amount of basic compounds, the chargeability is degraded because basic compounds exhibit a hole-trapping property.

When typical fluorine-containing resin particles containing a large amount of basic compounds are contained in the outermost surface layer of the electrophotographic photoreceptor, the residual potential may increase over time.

Thus, in the fluorine-containing resin particles, the amounts of carboxyl groups and the basic compound are suppressed to be within the aforementioned ranges so as to improve chargeability. Note that as long as the number of carboxyl groups and the amount of the basic compounds are suppressed within the aforementioned ranges, even when the number of carboxyl groups is relatively large, the chargeability tends to improve by using a relatively large amount of the basic compounds so that the ion conductivity and the hole-trapping property cancel out each other.

Thus, when the outermost surface layer of the electrophotographic photoreceptor contains fluorine-containing resin particles containing the amounts of carboxyl groups and basic compound within the aforementioned ranges, degradation of chargeability and the increase in residual potential are suppressed.

The number of carboxyl groups in the fluorine-containing resin particles may be 0 or more and 20 or less from the viewpoint of improving the chargeability.

The carboxyl groups in the fluorine-containing resin particle are, for example, carboxyl groups derived from the terminal carboxylic acid contained in the fluorine-containing resin particle.

Examples of the method for reducing the number of carboxyl groups in the fluorine-containing resin particle include 1) a method that does not apply radiation during the process of producing particles, and 2) a method in which irradiation is performed in the absence of oxygen or under a reduced oxygen concentration condition.

The number of carboxyl groups in the fluorine-containing resin particles is measured as follows according to the disclosure in Japanese Unexamined Patent Application Publication No. 4-20507, for example.

Fluorine-containing resin particles are pre-formed by a pressing machine into a film having a thickness of about 0.1 mm. An infrared absorption spectrum of the prepared film is measured. An infrared absorption spectrum of fluorine-containing resin particles in which carboxylic acid terminals are completely fluorinated by allowing the fluorine-containing resin particles to contact fluorine gas is also measured, and the number of terminal carboxyl groups is determined from the following formula from the difference between the two spectra:

$$\text{number of carboxyl groups (per } 10^6 \text{ carbon atoms)} = (l \times K)/t$$

l: absorbance

K: correction factor t: thickness (mm) of film

The absorption wavenumber of the carboxyl group is assumed to be 3560 $cm^{-1}$, and the correction factor is assumed to be 440.

Meanwhile, the amount of the basic compound in the fluorine-containing resin particles is preferably 0 ppm or more and 1.5 ppm or less and is more preferably 0 ppm or more and 1.2 ppm or less from the viewpoint of suppressing the increase in residual potential. The ppm is on a mass basis.

Examples of the basic compound in the fluorine-containing resin particles include 1) basic compounds derived from a polymerization initiator used in polymerization and particle formation of the fluorine-containing resin particles, 2) basic compounds used in the agglomerating process following the polymerization, and 3) basic compounds used as a dispersion aid for stabilizing the dispersion after the polymerization.

Examples of the basic compound include amine compounds, hydroxides of alkali metals and alkaline earth metals, oxides of alkali metals and alkaline earth metals, and acetic acid salts (in particular, amine compounds).

Examples of the basic compound are basic compounds having a boiling point (boiling point at normal pressure (1 atm)) of 40° C. or more and 130° C. or less (preferably 50° C. or more and 110° C. or less and more preferably 60° C. or more and 90° C. or less).

Examples of the amine compound include primary amine compounds, secondary amine compounds, and tertiary amine compounds.

Examples of the primary amine compound include methylamine, ethylamine, propylamine, isopropylamine, n-butylamine, isobutylamine, t-butylamine, hexylamine, 2-ethylhexylamine, secondary butylamine, allylamine, and methylhexylamine.

Examples of the secondary amine compound include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di-secondary butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amine compound include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the hydroxides of alkali metals and alkaline earth metals include NaOH, KOH, $Ca(OH)_2$, $Mg(OH)_2$, and $Ba(OH)_2$.

Examples of the oxides of alkali metals and alkaline earth metals include CaO and MgO.

Examples of the acetic acid salts include zinc acetate and sodium acetate.

Examples of the method for reducing the amount of basic compounds in the fluorine-containing resin particles include 1) a method that involves washing with water, an organic solvent (an alcohol such as methanol, ethanol, or isopropanol, tetrahydrofuran, or the like) after particles are formed, and 2) a method that involves heating (for example, heating to 200° C. or more and 250° C. or less) particles after the particles are formed to remove basic compounds by decomposition and evaporation.

The amount of the basic compounds in the fluorine-containing resin particles is measured as follows.

Pretreatment

The outermost surface layer containing fluorine-containing resin particles is immersed in a solvent (for example, tetrahydrofuran) to dissolve substances other than those insoluble in the solvent and fluorine-containing resin particles, the obtained solution is then added to pure water dropwise, and precipitates are separated by filtration. A solution containing perfluorooctanoic acid (PFOA) obtained during this process is collected. The insoluble matter obtained by filtration is further dissolved in a solvent, the resulting solution is added to pure water dropwise, and precipitates are separated by filtration. This operation is performed five times to obtain fluorine-containing resin particles used as a measurement sample.

In the case where a composition containing fluorine-containing resin particles is the subject of the measurement, the same processes as with the outermost surface layer are performed on the composition to obtain fluorine-containing resin particles used as a measurement sample.

In the case where the fluorine-containing resin particles are directly measured, the same processes as with the outermost surface layer are performed on the fluorine-containing resin particles to obtain fluorine-containing resin particles used as a measurement sample.

Measurement

Meanwhile, basic compound solutions (methanol solvent) with known concentrations are subjected to gas chromatography to obtain a calibration curve (calibration curve from 0 ppm to 100 ppm) from the values of the basic compound concentrations and the peak areas of the basic compound solutions (methanol solvent) having known concentrations.

Then measurement samples are measured by gas chromatography to calculate the amount of the basic compounds in the fluorine-containing resin particles from the obtained peak area and the calibration curve. The measurement conditions are as follows.

Measurement Conditions

Headspace sampler: HP7694 produced by HP

Measurement instrument: gas chromatograph (HP6890 series produced by HP)

Detector: hydrogen flame ionization detector (FID)

Column: HP19091S-433 produced by HP

Sample heating time: 10 min

Split ratio: 300:1

Flow rate: 1.0 ml/min

Column temperature elevation setting: 60° C. (3 min), 60° C./min, 200° C. (1 min)

The fluorine-containing resin particles may be polymerized fluorine-containing resin particles. As mentioned above, the polymerized fluorine-containing resin particles are formed into particles during polymerization such as suspension polymerization or emulsion polymerization, and are not irradiated.

An example of the method for preparing fluorine-containing resin particles by suspension polymerization involves suspending, in a dispersion medium, a monomer that forms a fluorine-containing resin, and additives such as a polymerization initiator and a catalyst, and then forming particles of a polymer while polymerizing the monomer.

An example of the method for preparing fluorine-containing resin particles by emulsion polymerization involves emulsifying, in a dispersion medium, a monomer that forms a fluorine-containing resin, and additives such as a polymerization initiator and a catalyst by using a surfactant (namely, an emulsifier), and then forming particles of a polymer while polymerizing the monomer.

In particular, the fluorine-containing resin particles may be particles obtained without irradiation in the production process.

However, irradiated fluorine-containing resin particles that have been irradiated with radiation in the absence of oxygen or under a reduced oxygen concentration condition may be used as the fluorine-containing resin particles.

The average particle diameter of the fluorine-containing resin particles is not particularly limited, but is preferably 0.2 μm or more and 4.5 μm or less and more preferably 0.2 μm or more and 4 μm or less. Fluorine-containing resin particles having an average particle diameter of 0.2 μm or more and 4.5 μm or less (in particular, fluorine-containing resin particles such as PTFE particles and the like) have a tendency to contain a large amount of PFOA. Thus, fluorine-containing resin particles having an average particle diameter of 0.2 μm or more and 4.5 μm or less tend to exhibit low chargeability. However, limiting the amount of PFOA to be within the above-described range improves chargeability of even fluorine-containing resin particles having an average particle diameter of 0.2 μm or more and 4.5 μm or less.

The average particle diameter of the fluorine-containing resin particles is the value measured by the following method.

Using a scanning electron microscope (SEM), particles are observed at a magnification of, for example, 5000× or more, the maximum diameters of the fluorine-containing resin particles (secondary particles formed by agglomeration of primary particles) are measured, and the average of fifty particles is used as the average particle diameter of the fluorine-containing resin particles. The SEM used is JSM-6700F produced by JEOL Ltd., and a secondary electron image at an accelerating voltage of 5 kV is observed.

The specific surface area (BET specific surface area) of the fluorine-containing resin particles is preferably 5 $m^2/g$ or more and 15 $m^2/g$ or less and more preferably 7 $m^2/g$ or more and 13 $m^2/g$ or less from the viewpoint of dispersion stability.

The specific surface area is a value measured by a BET-type specific surface area meter (FlowSorb 112300 produced by Shimadzu Corporation) by a nitrogen substitution method.

The apparent density of the fluorine-containing resin particles is preferably 0.2 g/ml or more and 0.5 g/ml or less and more preferably 0.3 g/ml or more and 0.45 g/ml or less from the viewpoint of dispersion stability.

The apparent density is a value measured in accordance with JIS K 6891 (1995).

The melting temperature of the fluorine-containing resin particles is preferably 300° C. or more and 340° C. or less and more preferably 325° C. or more and 335° C. or less.

The melting temperature is a melting temperature measured in accordance with JIS K 6891 (1995).

Fluorine Graft Polymer

A fluorine graft polymer is a dispersant containing fluorine atoms.

Examples of the fluorine graft polymer include polymers obtained by homopolymerization or copolymerization of polymerizable compounds having fluorinated alkyl groups (hereinafter these polymers may be referred to as "fluorinated alkyl group-containing polymers").

Specific examples of the fluorine graft polymer include homopolymers of (meth)acrylates having fluorinated alkyl groups, and random or block copolymers obtained from (meth)acrylates having fluorinated alkyl groups and fluorine atom-free monomers. Note that (meth)acrylates refer to both acrylates and methacrylates.

Examples of the (meth)acrylates having fluorinated alkyl groups include 2,2,2-trifluoroethyl (meth)acrylate and 2,2,3,3,3-pentafluoropropyl (meth)acrylate.

Examples of the fluorine atom-free monomers include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth) acrylate, 2-methoxyethyl (meth)acrylate, methoxytriethylene glycol (meth)acrylate, 2-ethoxyethyl (meth)acrylate, tetrahydrofurfuryl (meth)acrylate, benzyl (meth)acrylate, ethylcarbitol (meth)acrylate, phenoxyethyl (meth)acrylate, 2-hydroxy (meth)acrylate, 2-hydroxypropyl (meth)acrylate, 4-hydroxybutyl (meth)acrylate, methoxypolyethylene glycol (meth)acrylate, phenoxypolyethylene glycol (meth)acrylate, hydroxyethyl-o-phenylphenol (meth)acrylate, and o-phenylphenol glycidyl ether (meth)acrylate.

Other specific examples of the fluorine graft polymer include block or branched polymers disclosed in the U.S. Pat. No. 5,637,142 and Japanese Patent No. 4251662. Other specific examples of the fluorine graft polymer include fluorine surfactants.

Among these, the fluorine graft polymer is preferably a fluorinated alkyl group-containing polymer having a structural unit represented by general formula (FA) below and is more preferably a fluorinated alkyl group-containing polymer having a structural unit represented by general formula (FA) below and a structural unit represented by general formula (FB) below.

In the description below, the fluorinated alkyl group-containing polymer having a structural unit represented by general formula (FA) below and a structural unit represented by general formula (FB) below is described.

(FA)

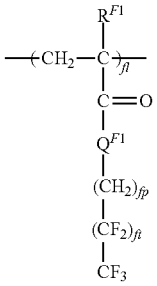

(FB)

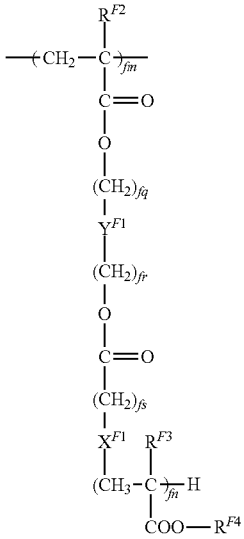

In general formulae (FA) and (FB), $R^{F1}$, $R^{F2}$, $R^{F3}$, and $R^{F4}$ each independently represent a hydrogen atom or an alkyl group, $X^{F1}$ represents an alkylene chain, a halogen-substituted alkylene chain, —S—, —O—, —NH—, or a single bond, $Y^{F1}$ represents an alkylene chain, a halogen-substituted alkylene chain, —($C_{fx}H_{2fx-1}$(OH))—, or a single bond, $Q^{F1}$ represents —O— or —NH—, fl, fm, and fn each independently represent an integer of 1 or more, fp, fq, fr, and fs each independently represent 0 or an integer of 1 or more, ft represents an integer of 1 or more and 7 or less, and fx represents an integer of 1 or more.

In general formulae (FA) and (FB), a hydrogen atom, a methyl group, an ethyl group, a propyl group, etc., are preferable as the groups represented by $R^{F1}$, $R^{F2}$, $R^{F3}$, and $R^{F4}$. A hydrogen atom and a methyl group are more preferable, and a methyl group is yet more preferable.

In general formulae (FA) and (FB), linear or branched alkylene chains having 1 to 10 carbon atoms may be used as the alkylene chains (unsubstituted alkylene chains and halogen-substituted alkylene chains) represented by $X^{F1}$ and $Y^{F1}$.

In —($C_{fx}H_{2fx-1}$(OH))— represented by $Y^{F1}$, fx may represent an integer of 1 or more and 10 or less.

Furthermore, fp, fq, fr, and fs may each independently represent 0 or an integer of 1 or more and 10 or less.

For example, fn may be 1 or more and 60 or less.

Here, in the fluorine graft polymer, the ratio of the structural unit represented by general formula (FA) to the structural unit represented by general formula (FB), in other words, fl:fm, is preferably in the range of 1:9 to 9:1 and more preferably in the range of 3:7 to 7:3.

The fluorine graft polymer may further contain a structural unit represented by general formula (FC) in addition to the structural unit represented by general formula (FA) and the structural unit represented by general formula (FB). The content ratio (fl+fm:fz) of the total (fl+fm) of the structural units represented by general formulae (FA) and (FB) to the structural unit represented by general formula (FC) is preferably in the range of 10:0 to 7:3 and is more preferably in the range of 9:1 to 7:3.

(FC)

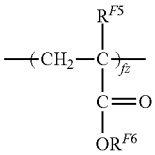

In general formula (FC), $R^{F5}$ and $R^{F6}$ each independently represent a hydrogen atom or an alkyl group. Furthermore, fz represents an integer of 1 or more.

In general formula (FC), a hydrogen atom, a methyl group, an ethyl group, a propyl group, etc., may be used as the groups represented by $R^{F5}$ and $R^{F6}$. A hydrogen atom and a methyl group are more preferable, and a methyl group is yet more preferable.

Examples of the commercially available products of the fluorine graft polymer include GF300 and GF400 (produced by Toagosei Co, Ltd.), Surflon series (produced by AGC SEIMI CHEMICAL CO., LTD.), Ftergent series (produced by NEOS Company Limited), PF series (produced by Kitamura Chemicals Co., Ltd.), Megaface series (produced by DIC Corporation), and FC series (produced by 3M).

The weight-average molecular weight Mw of the fluorine graft polymer is preferably 20,000 or more and 200,000 or less and more preferably 50,000 or more and 200,000 or less from the viewpoint of improving the dispersibility of the fluorine-containing resin particles.

The weight-average molecular weight of the fluorine graft polymer is a value measured by gel permeation chromatography (GPC). The molecular weight measurement by GPC is conducted by, for example, using GPC•HLC-8120 produced by TOSOH CORPORATION as a measurement instrument with TSKgel GMHHR-M+TSKgel GMHHR-M columns (7.8 mm I.D., 30 cm) produced by TOSOH CORPORATION and a chloroform solvent, and calculating the molecular weight from the measurement results by using a molecular weight calibration curve prepared from a monodisperse polystyrene standard sample.

The amount of the fluorine graft polymer relative to, for example, the fluorine-containing resin particles is preferably 0.5 mass % or more and 10 mass % or less and more preferably 1 mass % or more and 7 mass % or less.

The fluorine graft polymers may be used alone or in combination.

Acidic Compound

The acidic compound has an acid dissociation constant (pKa) of 3 or less in water at 25° C.

Here, the acid dissociation constant (pKa) refers to a first acid dissociation constant (pKa1).

The acid dissociation constant (pKa) of the acidic compound is preferably −2.8 or more and 2.5 or less, more preferably −2.1 or more and 2.5 or less, yet more preferably −2 or more and 2.5 or less, and most preferably 0.5 or more and 2 or less from the viewpoint of suppressing the increase in residual potential.

The acidic compound may be an inorganic acid or an organic acid. One acidic compound may be used or two or more acidic compounds may be used in combination.

Examples of the inorganic acid include phosphoric acid compounds (compounds having $PO^{-3}$ groups, for example, phosphoric acid), and nitric acid compounds (compounds having $NO_3^-$ groups, for example, nitric acid).

Examples of the organic acid include sulfonic acid compounds and carboxylic acid compounds.

A sulfonic acid compound is a compound having a $SOH_3^-$ group. Examples of the sulfonic acid compound include a sulfonic acid compound having a benzene ring substituted with an alkyl group having 1 or more and 20 or less carbon atoms (preferably 1 or more and 12 or less carbon atoms) (for example, toluenesulfonic acid, benzenesulfonic acid, dodecylbenzenesulfonic acid, 2,4-dimethylbenzenesulfonic acid, and hydroxybenzenesulfonic acid), an alkyl sulfonic acid having 1 or more and 6 or less (preferably 1 or more and 4 or less) carbon atoms (for example, methylsulfonic acid, ethylsulfonic acid, propanesulfonic acid, and butanesulfonic acid), and hydrates thereof.

A carboxylic acid compound is a compound having a —COOH group. Examples of the carboxylic acid compound include oxalic acid, N,N-dimethylanthranilic acid, maleic acid, pyromellitic acid, pyruvic acid, tartaric acid, citric acid, trifluoroacetic acid, and phthalic acid.

In other words, from the viewpoint of suppressing the increase in residual potential, the acidic compound may be at least one acidic compound selected from the group consisting of a sulfonic acid compound, a carboxylic acid compound, a phosphoric acid compound, and a nitric acid compound.

Of these, at least one acidic compound selected from the group consisting of a sulfonic acid compound and a carboxylic acid compound is preferable as the acidic compound, and at least one acidic compound selected from the group consisting of a sulfonic acid compound having a benzene ring and a carboxylic acid compound having 2 or more and 4 or less carboxyl groups is more preferable.

The amount of the acidic compound relative to the outermost surface layer is 100 ppm or more and 5000 ppm or less. The amount of the acidic compound contained is preferably 100 ppm or more and 5000 ppm or less, more preferably 150 ppm or more and 5000 ppm or less, and most preferably 200 ppm or more and 2000 ppm or less from the viewpoint of suppressing the increase in residual potential. The ppm is on a mass basis.

When the outermost surface layer contains 100 ppm or more of the acidic compound, the increase in residual potential is suppressed. Meanwhile, when the outermost surface layer contains a large amount of the acidic compound, the chargeability is degraded due to the influence of humidity (specifically, dark decay increases, and the charge-retaining property is degraded). Thus, the amount of the acidic compound is set to 10000 ppm or less.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or more and 48° C. or less. The thickness of the film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with heated steam at 90° C. or higher and 120° C. or lower for 5 to 60 minutes. The thickness of the film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

As the inorganic particles having this resistance value, for example, metal oxide particles such as tin oxide particles, titanium oxide particles, zinc oxide particles, or zirconium oxide particles are preferable, and, in particular, zinc oxide particles are preferable.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, preferably 10 mass % or more and 80 mass % or less, and is more preferably 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate coupling agent, an aluminum coupling agent, and a surfactant. In particular, a silane coupling agent is preferable, and an amino-group-containing silane coupling agent is more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent may be used in combination with an additional silane coupling agent. Examples of this additional silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of improving long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, and is preferably 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

In order to suppress moire images, the surface roughness (ten-point average roughness) of the undercoat layer may be adjusted to be in the range of 1/(4n) (n represents the refractive index of the overlying layer) to ½ of λ representing the laser wavelength used for exposure.

In order to adjust the surface roughness, resin particles and the like may be added to the undercoat layer.

Examples of the resin particles include silicone resin particles and crosslinking polymethyl methacrylate resin particles. The surface of the undercoat layer may be polished to adjust the surface roughness. Examples of the polishing method included buff polishing, sand blasting, wet honing, and grinding.

The undercoat layer may be formed by any known method. For example, a coating film is formed by using an undercoat layer-forming solution prepared by adding the above-mentioned components to a solvent, dried, and, if needed, heated.

Examples of the solvent used for preparing the undercoat layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat layer-forming solution include known methods that use a roll mill, a ball mill, a vibrating ball mill, an attritor, a sand mill, a colloid mill, and a paint shaker.

Examples of the method for applying the undercoat layer-forming solution to the conductive substrate include common methods such as a blade coating method, a wire bar coating method, a spray coating method, a dip coating method, a bead coating method, an air knife coating method, and a curtain coating method.

The thickness of the undercoat layer is preferably set within the range of 15 μm or more, and more preferably within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanine disclosed in Japanese Unexamined Patent Application Publication Nos. 5-140472 and 5-140473; and titanyl phthalocyanine disclosed in Japanese Unexamined Patent Application Publication No. 4-189873.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment disclosed in Japanese Unexamined Patent Application Publication Nos. 2004-78147 and 2005-181992, or the like.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed. Examples of the n-type charge generating material include, but are not limited to, compounds (CG-1) to (CG-27) described in Japanese Unexamined Patent Application Publication No. 2012-155282, paragraphs [0288] to [0291].

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using an charge generating layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge generating layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

In order to disperse particles (for example, the charge generating material) in the charge generating layer-forming solution, a media disperser such as a ball mill, a vibrating ball mill, an attritor, a sand mill, or a horizontal sand mill, or a media-less disperser such as stirrer, an ultrasonic disperser, a roll mill, or a high-pressure homogenizer can be used. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge generating layer-forming solution to 0.5 μm or less, preferably 0.3 μm or less, and more preferably 0.15 μm or less.

Examples of the method for applying the charge generating layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer is preferably set within the range of, for example, 0.1 μm or more and 5.0 μm or less, and more preferably within the range of 0.2 μm or more and 2.0 μm or less.

Charge Transporting Layer

The charge transporting layer is, for example, a layer that contains a charge transporting material and a binder resin. The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

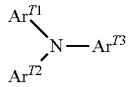

(a-1)

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

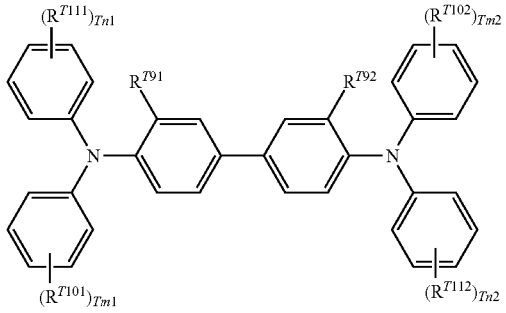

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials disclosed in Japanese Unexamined Patent Application Publication Nos. 8-176293 and 8-208820 are particularly preferable. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The charge transporting layer may contain other known additives.

The charge transporting layer may be formed by any known method. For example, a coating film is formed by using a charge transporting layer-forming solution prepared by adding the above-mentioned components to a solvent, dried, and, if needed, heated.

Examples of the solvent used to prepare the charge transporting layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge transporting layer-forming solution to the charge generating layer include common methods such as a blade coating method, a wire bar coating method, a spray coating method, a dip coating method, a bead coating method, an air knife coating method, and a curtain coating method.

The thickness of the charge transporting layer is preferably set within the range of, for example, 5 μm or more and 50 μm or less, and more preferably within the range of 10 μm or more and 30 μm or less.

Protective Layer

A protective layer is disposed on a photosensitive layer if necessary. The protective layer is, for example, formed to avoid chemical changes in the photosensitive layer during charging and further improve the mechanical strength of the photosensitive layer.

Thus, the protective layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include known reactive groups such as chain-polymerizable groups, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives thereof. Among these, the chain-polymerizable group may be a group that contains at least one selected from a vinyl group, a styryl group (vinylphenyl group), an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton is preferable.

The reactive-group-containing charge transporting material that has such a reactive group and a charge transporting skeleton, the non-reactive charge transporting material, and the reactive-group-containing non-charge transporting material may be selected from among known materials.

The protective layer may contain other known additives.

The protective layer may be formed by any known method. For example, a coating film is formed by using a protective layer-forming solution prepared by adding the above-mentioned components to a solvent, dried, and, if needed, cured such as by heating.

Examples of the solvent used to prepare the protective layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective layer-forming solution may be a solvent-free solution.

Examples of the application method used to apply the protective layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protective layer is preferably set within the range of, for example, 1 μm or more and 20 μm or less, and more preferably within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, optionally, a binder resin and other known additives. These materials are the same as those described in relation to the charge generating layer and the charge transporting layer.

The amount of the charge generating material contained in the single-layer-type photosensitive layer relative to the total solid content may be 0.1 mass % or more and 10 mass % or less, and is preferably 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, and is preferably 10 μm or more and 40 μm or less.

Image Forming Apparatus (and Process Cartridge)

An image forming apparatus of an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The electrophotographic photoreceptor of the exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the electrophotographic photoreceptor of the exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 2:
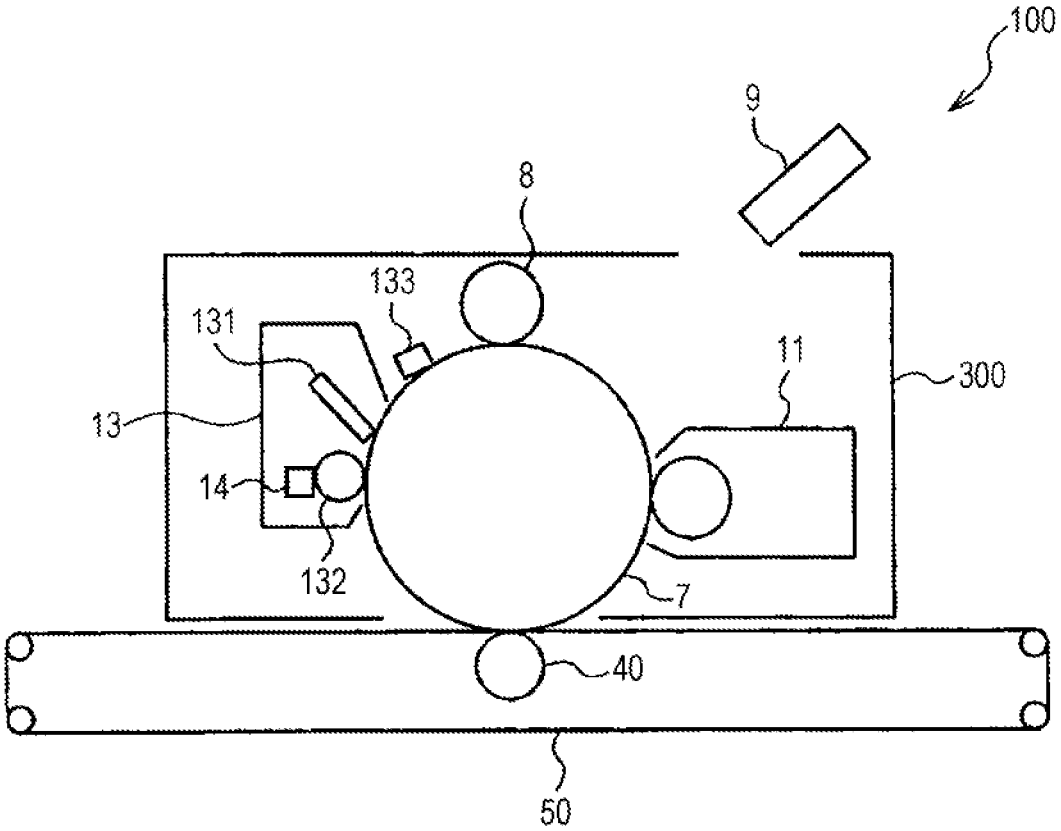
FIG. 2 is a schematic diagram illustrating one example of an image forming apparatus according to an exemplary embodiment.

FIG. 2 is a schematic diagram illustrating one example of an image forming apparatus according to an exemplary embodiment.

As illustrated in FIG. 2, an image forming apparatus 100 of this exemplary embodiment includes a process cartridge 300 equipped with an electrophotographic photoreceptor 7, an exposing device 9 (one example of the electrostatic latent image forming unit), a transfer device 40 (first transfer device), and an intermediate transfer body 50. In this image forming apparatus 100, the exposing device 9 is positioned so that light can be applied to the electrophotographic photoreceptor 7 from the opening of the process cartridge 300, the transfer device 40 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 40 (first transfer device), and the second transfer device (not illustrated) correspond to examples of the transfer unit.

The process cartridge 300 illustrated in FIG. 2 integrates and supports the electrophotographic photoreceptor 7, a charging device 8 (one example of the charging unit), a developing device 11 (one example of the developing unit), and a cleaning device 13 (one example of the cleaning unit) in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 2, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also used.

Exposing Device

Examples of the exposing device 9 include optical devices that can apply light, such as semiconductor laser light, LED, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

Instead of the cleaning blade type, a fur brush cleaning type device or a development-cleaning simultaneous type device may be employed.

Transfer Device

Examples of the transfer device 40 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber, or the like is used as the intermediate transfer body 50. The form of the intermediate transfer body other than the belt may be a drum.

Figure 3:
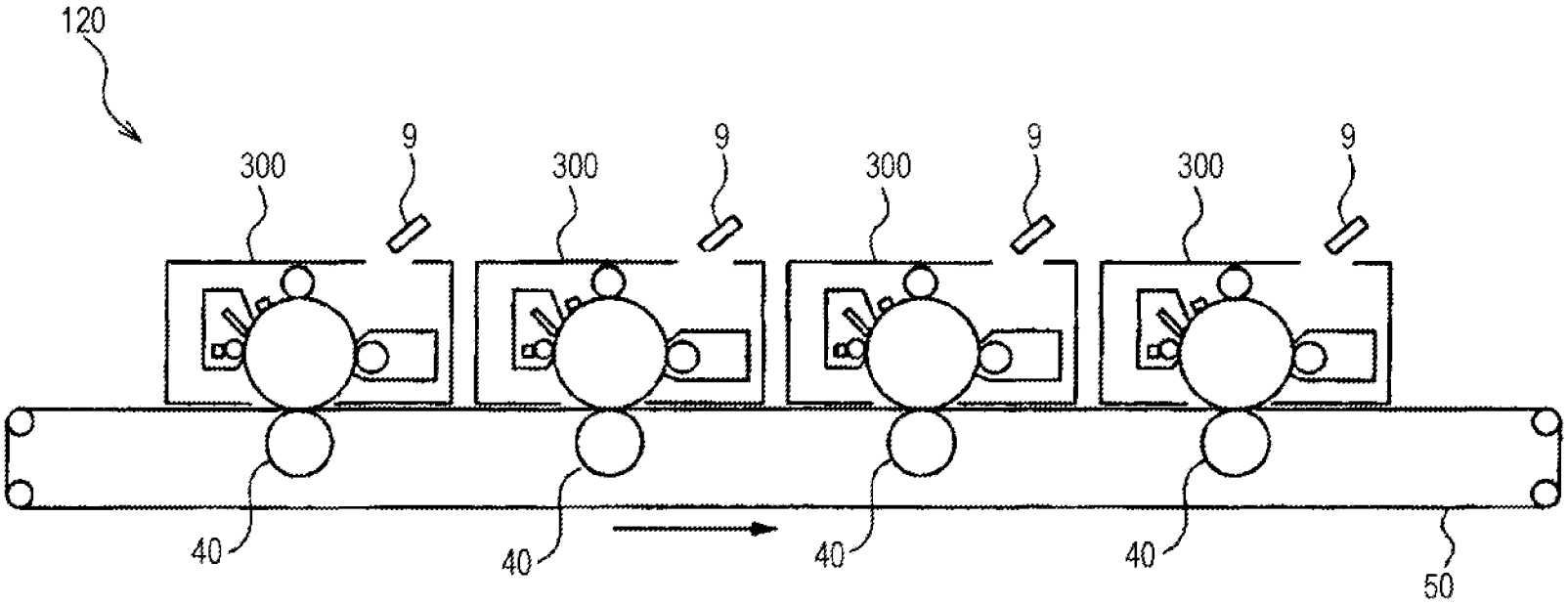
FIG. 3 is a schematic diagram illustrating another example of an image forming apparatus according to an exemplary embodiment.

FIG. 3 is a schematic diagram illustrating another example of the image forming apparatus according to the exemplary embodiment.

An image forming apparatus 120 illustrated in FIG. 3 is a tandem-system multicolor image forming apparatus equipped with four process cartridges 300. In the image forming apparatus 120, four process cartridges 300 are arranged in parallel on the intermediate transfer body 50, and one electrophotographic photoreceptor is used for one color. The image forming apparatus 120 is identical to the image forming apparatus 100 except for the tandem system.

EXAMPLES

Examples of the present disclosure will now be described in further detail, but the present disclosure is not limited by the examples. Unless otherwise noted, "parts" and "%" are on a mass basis.

Preparation of Fluorine-Containing Resin Particles

Preparation of Fluorine-Containing Resin Particles (1)

Fluorine-containing resin particles (1) are produced as follows.

Into a barrier nylon bag, 100 parts by mass of a homopolytetrafluoroethylene fine powder (standard specific gravity measured in accordance with ASTM D 4895 (2004): 2.175) and 2.4 parts by mass of ethanol serving as an additive are sampled, and the entire bag is substituted with nitrogen. Subsequently, a cobalt $-60\gamma$ line is applied at 150 kGy at room temperature to obtain a low-molecular-weight polytetrafluoroethylene powder. The obtained powder is crushed to obtain fluorine-containing resin particles (1).

Preparation of Fluorine-Containing Resin Particles (2)

One hundred parts by mass of the fluorine-containing resin particles (1) and 400 parts by mass of methanol are taken, the mixture is washed for 20 minutes in a stirrer at 250 rpm while applying ultrasonic waves, and the supernatant is filtered. This operation is repeated three times, and the filtrate is dried at a reduced pressure at 60 degrees for 17 hours to produce fluorine-containing resin particles (2).

Preparation of Fluorine-Containing Resin Particles (3)

Fluorine-containing resin particles (3) are prepared as with the fluorine-containing resin particles (1) except that the entire bag is substituted with nitrogen so that the oxygen concentration used in producing the fluorine-containing resin particles (1) is changed to 8%.

Preparation of Fluorine-Containing Resin Particles (4)

Fluorine-containing resin particles (4) are prepared as with the fluorine-containing resin particles (2) except that the fluorine-containing resin particles (3) are used instead of the fluorine-containing resin particles (1) used in preparing the fluorine-containing resin particles (2).

Preparation of Fluorine-Containing Resin Particles (5)

Into an autoclave, 3 L of deionized water, 3.0 g of ammonium perfluorooctanoate, and 110 g of paraffin wax (produced by Nippon Oil Corporation) serving as an emulsion stabilizer are charged, the interior is substituted with nitrogen three times and with tetrafluoroethylene (TFE) twice to remove oxygen, and stirring is performed at 250 rpm by adjusting the internal pressure to 1.0 MPa with TFE while maintaining the internal temperature to 70° C. Next, ethane in an amount equivalent to 150 cc at normal pressure serving as a chain transfer agent and 20 mL of an aqueous solution dissolving 300 mg of ammonium persulfate serving as a polymerization initiator are charged into the system, and the reaction is started. During the reaction, the temperature inside the system is maintained at 70° C., and TFE is continuously supplied so that the internal pressure of the autoclave is constantly maintained at 1.0±0.05 MPa. At the time 1000 g of TFE is consumed by the reaction after addition of the initiator, supply of TFE and stirring are stopped, and the reaction is terminated. Subsequently, particles are centrifugally separated, 400 parts by mass of methanol is taken, the mixture is washed for 10 minutes in a stirrer at 250 rpm while applying ultrasonic waves, and the supernatant is filtered. This operation is repeated three times, and the filtrate is dried at a reduced pressure at 60° C. for 17 hours.

Through the above-described steps, fluorine-containing resin particles (5) are produced.

Preparation of Fluorine-Containing Resin Particles (6)

Fluorine-containing resin particles (6) are prepared as with the fluorine-containing resin particles (5) except that 4.5 g of triethylamine is added after completion of the reaction in the production of the fluorine-containing resin particles (5).

Preparation of Fluorine-Containing Resin Particles (C1)

Fluorine-containing resin particles (C1) are prepared as with the fluorine-containing resin particles (1) except that, in producing the fluorine-containing resin particles (1), irradiation with radiation is performed in air.

Preparation of Fluorine-Containing Resin Particles (C2)

Fluorine-containing resin particles (C2) are prepared as with the fluorine-containing resin particles (2) except that the fluorine-containing resin particles (C1) are used instead of the fluorine-containing resin particles (1) used in producing the fluorine-containing resin particles (2).

Preparation of Fluorine-Containing Resin Particles (C3)

Fluorine-containing resin particles (C3) are prepared as with the fluorine-containing resin particles (6) except that in producing the fluorine-containing resin particles (6), the washing operation is performed once.

Example 1

Preparation of Photoreceptor

A photoreceptor is prepared as follows by using the obtained fluorine-containing resin particles.

One hundred parts of zinc oxide (average particle diameter: 70 nm, produced by Tayca Corporation, specific surface area: 15 $m^2/g$) is mixed with 500 parts of tetrahydrofuran, and 1.4 parts of a silane coupling agent (KBE503 produced by Shin-Etsu Chemical Co., Ltd.) is added thereto, followed by stirring for 2 hours. Then, tetrahydrofuran is distilled away by vacuum distillation, baking is performed at 120° C. for 3 hours, and, as a result, zinc oxide surface-treated with the silane coupling agent is obtained.

One hundred and ten parts of the surface-treated zinc oxide and 500 parts of tetrahydrofuran are mixed and stirred, a solution prepared by dissolving 0.6 parts of alizarin in 50 parts of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts of the alizarin-doped zinc oxide, 13.5 parts of a curing agent (blocked isocyanate, Sumidur 3175 produced by Sumitomo Bayer Urethane Co., Ltd.), 15 parts of a butyral resin (S-LEC BM-1 produced by Sekisui Chemical Co., Ltd.), and 85 parts of methyl ethyl ketone are mixed to obtain a mixed solution. Thirty eight parts of this mixed solution and 25 parts of methyl ethyl ketone are mixed, and the resulting mixture is dispersed for 2 hours in a sand mill using 1 mmϕ glass beads to obtain a dispersion.

To the obtained dispersion, 0.005 parts of dioctyltin dilaurate serving as a catalyst and 30 parts of silicone resin particles (Tospearl 145 produced by Momentive Performance Materials Japan LLC) are added to obtain an undercoat layer-forming solution. The coating solution is applied to a cylindrical aluminum substrate, and dried and cured at 170° C. for 30 minutes so as to form an undercoat layer having a thickness of 24 μm.

Next, 1 part of hydroxygallium phthalocyanine having intense diffraction peaks at Bragg's angles (2θ±0.2°) of 7.5°, 9.9°, 12.5°, 16.3°, 18.6°, 25.1°, and 28.3° in an X-ray diffraction spectrum, 1 part of polyvinyl butyral (S-LEC BM-5 produced by Sekisui Chemical Co., Ltd.), and 80 parts of n-butyl acetate are mixed, and the resulting mixture is dispersed with glass beads in a paint shaker for 1 hour to prepare a charge generating layer-forming solution. The obtained solution is applied to the undercoat layer on the conductive support by dip-coating, and heated at 130° C. for 10 minutes to form a charge generating layer having a thickness of 0.15 μm.

In 350 parts of toluene and 150 parts of tetrahydrofuran, 45 parts of a benzidine compound represented by formula (CTM1) below serving as a charge transporting material, 55 parts of a polymer compound (viscosity-average molecular weight: 40,000) having a repeating unit represented by formula (PCZ1) below serving as a binder resin, and 0.0111 parts (100 ppm) of dodecylbenzenesulfonic acid serving as an acidic compound (hereinafter, the acidic compound is mixed so that the amount thereof is as indicated in Table 1 (the amount (ppm) relative to the solid content of the outermost surface layer)) are dissolved. Then, 9.8 parts of the fluorine-containing resin particles (1) and 1 part of a fluorine-containing dispersant GF400 (produced by Toagosei Co., Ltd.) are added to the resulting solution, and the resulting mixture is treated five times with a high-pressure homogenizer to prepare a charge generating layer-forming coating solution.

The obtained coating solution is applied to the charge generating layer by dip-coating, and heated at 130° C. for 45 minutes to prepare a charge transporting layer having a thickness of 31 μm.

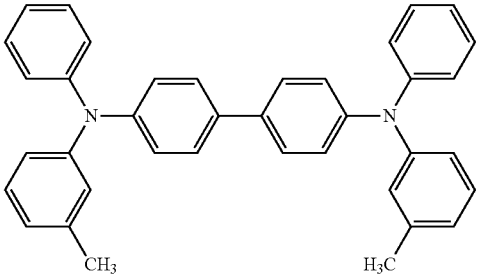

(CTM1)

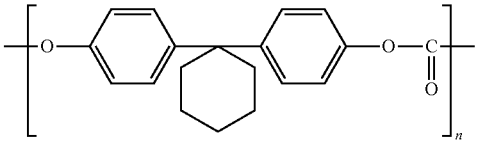

(PCZ1)

Photoreceptors are prepared through the steps described above.

Examples 2 to 22 and Comparative Examples 1 to 3

Photoreceptors are prepared as in Example 1 except that the type and amount of the acidic compound and the type of the fluorine-containing resin particles are changed.

Evaluation

Various Measurements

The following properties of the fluorine-containing resin particles are measured by the aforementioned methods.

The number of carboxyl groups (in the table, indicated as "COOH") per $10^6$ carbon atoms The amount of basic compounds (ppm)

Actual Device Evaluation

Image Forming Apparatus for Evaluation

The obtained electrophotographic photoreceptor is attached to DocuCentre-VC7775 produced by Fuji Xerox Co., Ltd.

By using a surface potentiometer (Trek 334 produced by Trek Japan Co., Ltd.), a surface potential probe is installed at a position 1 mm remote from the surface of the photoreceptor and in the region to be measured.

This apparatus is used as the image forming apparatus for evaluation.

Evaluation of Charge-Retaining Property

The chargeability of the obtained photoreceptor is evaluated as follows.

After the surface potential after charging is set to −700 V, by using the image forming apparatus for evaluation, an all-screen halftone image having an image density of 30% is output on 70,000 sheets of A4 paper in a high-temperature, high-humidity environment (temperature: 28° C., humidity: 85% RH). Then the surface potential is measured with a surface potentiometer and evaluated by the following evaluation standard:

5: The surface potential is −700 V or more and less than −690 V.

4: The surface potential is −690V or more and less than −675V.

3: The surface potential is −675 V or more and less than −660 V (practically acceptable level).

2: The surface potential is −660V or more and less than −640V.

1: The surface potential is −640 V or more.

Evaluation of Residual Potential

The residual potential of the obtained photoreceptors is evaluated as follows.

After the surface potential after charging is set to −700 V, by using the image forming apparatus for evaluation, an all-screen halftone image having an image density of 30% is output on 70,000 sheets of A4 paper in a high-temperature, high-humidity environment (temperature: 28° C., humidity: 85% RH).

The initial residual potential of the photoreceptor after outputting 100 sheets and after charge erasing, and the aged residual potential of the photoreceptor after outputting 70,000 sheets and after charge erasing are measured with a surface potentiometer, the difference (absolute value) is determined, and the following evaluation is made.

5: The difference in residual potential is less than 5 V.

4: The difference in residual potential is 5 V or more and less than 10 V.

3: The difference in residual potential is 10 V or more and less than 20 V (practically acceptable level).

2: The difference in residual potential is 20 V or more and less than 50 V.

1: The difference in residual potential is 50 V or more.

Evaluation of Environmental Changes

The environmental changes that occurred in the obtained photoreceptors are evaluated as follows.

After evaluation of residual potential described above, the surface potential is set to −700 V in a low-temperature, low-humidity environment (an environment having a temperature of 15° C. and a humidity of 10% RH), and then the initial residual potential after 100 sheets of output is measured. The difference (absolute value) from the value in a high-temperature, high-humidity environment is determined, and the result is evaluated by the following standard.

4: The difference in residual potential is less than 10 V.

3: The difference in residual potential is 10 V or more and less than 20 V (practically acceptable level).

2: The difference in residual potential is 20 V or more and less than 50 V.

1: The difference in residual potential is 50 V or more.

Details of Examples and Comparative Examples are summarized in Tables 1 and 2.

In Tables 1 and 2, abbreviations are as follows.

$NH_3$: ammonia (boiling point=room temperature (25° C.) or lower)

TEA: triethylamine (boiling point: 89° C.)

DBS: dodecylbenzenesulfonic acid

TABLE 1

| | Fluorine-containing resin particles | | Basic compound | | Acidic compound | | | Evaluation | | |
|---|---|---|---|---|---|---|---|---|---|---|
| | Type | Amount of COOH (number) | Type | Amount (ppm) | Type | pKa | Amount (ppm) | Charge-retaining property | Residual potential | Environmental changes |
| Example 1 | (2) | 15 | TEA | 1 | DBS | −2 | 100 | 5 | 4 | 4 |
| Example 2 | (2) | 15 | TEA | 1 | DBS | −2 | 150 | 5 | 4 | 4 |
| Example 3 | (2) | 15 | TEA | 1 | DBS | −2 | 300 | 4 | 5 | 3 |
| Example 4 | (2) | 15 | TEA | 1 | Oxalic acid | 1.04 | 100 | 5 | 3 | 4 |
| Example 5 | (2) | 15 | TEA | 1 | Oxalic acid | 1.04 | 300 | 5 | 4 | 4 |
| Example 6 | (2) | 15 | TEA | 1 | Oxalic acid | 1.04 | 500 | 4 | 5 | 4 |
| Example 7 | (2) | 15 | TEA | 1 | Maleic acid | 1.75 | 300 | 5 | 3 | 4 |
| Example 8 | (2) | 15 | TEA | 1 | Maleic acid | 1.75 | 1000 | 4 | 4 | 4 |
| Example 9 | (2) | 15 | TEA | 1 | Maleic acid | 1.75 | 2000 | 3 | 5 | 3 |
| Example 10 | (2) | 15 | TEA | 1 | Malonic acid | 2.65 | 100 | 5 | 3 | 4 |
| Example 11 | (2) | 15 | TEA | 1 | Malonic acid | 2.65 | 1000 | 5 | 3 | 4 |
| Example 12 | (2) | 15 | TEA | 1 | Malonic acid | 2.65 | 3000 | 4 | 4 | 3 |
| Example 13 | (2) | 15 | TEA | 1 | Malonic acid | 2.65 | 5000 | 3 | 5 | 3 |
| Example 14 | (2) | 15 | TEA | 1 | Malonic acid | 2.65 | 7000 | 3 | 5 | 3 |
| Example 15 | (1) | 15 | TEA | 3 | Malonic acid | 2.65 | 1000 | 5 | 4 | 4 |
| Example 16 | (3) | 30 | TEA | 2 | Malonic acid | 2.65 | 1000 | 5 | 5 | 4 |
| Example 17 | (4) | 30 | TEA | 0 | Malonic acid | 2.65 | 1000 | 5 | 5 | 4 |
| Example 18 | (5) | 7 | $NH_3$ | 1 | Malonic acid | 2.65 | 1000 | 5 | 5 | 4 |
| Example 19 | (6) | 7 | TEA | 3 | Malonic acid | 2.65 | 1000 | 5 | 4 | 3 |
| Example 20 | (C1) | 75 | TEA | 4 | Malonic acid | 2.65 | 1000 | 4 | 4 | 3 |
| Example 21 | (C2) | 75 | TEA | 1 | Malonic acid | 2.65 | 1000 | 4 | 4 | 3 |
| Example 22 | (C3) | 7 | TEA | 10 | Malonic acid | 2.65 | 1000 | 5 | 4 | 3 |

TABLE 2

| | Fluorine-containing resin particles | | Basic compound | | Acidic compound | | | Evaluation | | |
|---|---|---|---|---|---|---|---|---|---|---|
| | Type | Amount of COOH (number) | Type | Amount (ppm) | Type | pKa | Amount (ppm) | Charge-retaining property | Residual potential | Environmental changes |
| Comparative Example 1 | (2) | 15 | TEA | 1 | Isophthalic acid | 3.54 | 1000 | 5 | 2 | 3 |
| Comparative Example 2 | (2) | 15 | TEA | 1 | Malonic acid | 2.65 | 50 | 5 | 1 | 2 |
| Comparative Example 3 | (2) | 15 | TEA | 1 | Malonic acid | 2.65 | 11000 | 2 | 2 | 1 |

The results described above indicate Examples offer superior results to Comparative Examples in terms of residual potential of the photoreceptors.

Moreover, Examples also offer superior evaluation results in terms of chargeability, the environmental changes, and the charge-retaining property.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate; and a photosensitive layer on the conductive substrate, wherein:

an outermost surface layer of the electrophotographic photoreceptor contains fluorine-containing resin particles, a fluorine graft polymer, and an acidic compound having an acid dissociation constant (pKa) of 3 or less in water at 25° C., an amount of the acidic compound relative to the outermost surface layer is 150 ppm or more and 10000 ppm or less, the fluorine-containing resin particles contain 0 or more and 30 or less carboxyl groups per $10^6$ carbon atoms, and 0 ppm or more and 3 ppm or less of a basic compound, and the acidic compound is a carboxylic acid compound having 2 to 4 carboxyl groups.

2. The electrophotographic photoreceptor according to claim 1, wherein the acid dissociation constant (pKa) of the acidic compound is −2.8 or more and 2.5 or less.

3. The electrophotographic photoreceptor according to claim 2, wherein the acid dissociation constant (pKa) of the acidic compound is −2 or more and 1.5 or less.

4. The electrophotographic photoreceptor according to claim 1, wherein the amount of the acidic compound relative to the outermost surface layer is 150 ppm or more and 5000 ppm or less.

5. The electrophotographic photoreceptor according to claim 1, wherein the fluorine-containing resin particles contain 0 or more and 20 or less carboxyl groups per $10^6$ carbon atoms, and 0 ppm or more and 3 ppm or less of the basic compound.

6. The electrophotographic photoreceptor according to claim 5, wherein the fluorine-containing resin particles contain 0 or more and 20 or less carboxyl groups per $10^6$ carbon atoms, and 0 ppm or more and 1.5 ppm or less of the basic compound.

7. The electrophotographic photoreceptor according to claim 5, wherein the basic compound is an amine compound.

8. The electrophotographic photoreceptor according to claim 5, wherein the basic compound has a boiling point of 40° C. or higher and 130° C. or lower.

9. An electrophotographic photoreceptor comprising:

a conductive substrate; and a photosensitive layer on the conductive substrate, wherein:

an outermost surface layer of the electrophotographic photoreceptor contains fluorine-containing resin particles, a fluorine graft polymer, and a carboxylic acid compound having 2 or more and 4 or less carboxyl groups, an amount of the carboxylic acid compound having 2 or more and 4 or less carboxyl groups relative to the outermost surface layer is 150 ppm or more and 10000 ppm or less, and the fluorine-containing resin particles contain 0 or more and 30 or less carboxyl groups per $10^6$ carbon atoms, and 0 ppm or more and 3 ppm or less of a basic compound.

10. A process cartridge detachably attachable to an image forming apparatus, the process cartridge comprising the electrophotographic photoreceptor according to claim 1.

11. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor by using a developer containing a toner so as to form a toner image; and a transfer unit that transfers the toner image onto a surface of a recording medium.

* * * * *